United States Patent [19]

Chapman

[11] Patent Number: 4,562,520

[45] Date of Patent: Dec. 31, 1985

[54] FLOOR LAMP

[76] Inventor: Earle F. Chapman, 481 W. Main St., Avon, Mass. 02322

[21] Appl. No.: 615,674

[22] Filed: Jun. 1, 1984

Related U.S. Application Data

[63] Continuation of Ser. No. 261,675, May 7, 1981, abandoned.

[51] Int. Cl.[4] ..... F21S 1/12

[52] U.S. Cl. ..... 362/414; 362/427; 248/289.1

[58] Field of Search ..... 362/413, 427, 410, 430, 362/428, 419, 287, 275, 269, 414, 431, 282, 372; 248/280.1, 281.1, 289.1, 158, 122

[56] References Cited

U.S. PATENT DOCUMENTS

| | | | |
|---|---|---|---|
| 1,232,908 | 7/1917 | Feyrer | 362/413 X |
| 1,729,718 | 10/1929 | Green | 362/414 X |
| 1,895,410 | 1/1933 | Figlia | 362/414 X |
| 1,906,944 | 5/1933 | Arenberg | 362/414 X |
| 2,267,653 | 12/1941 | Hawkins | 362/413 X |
| 2,472,624 | 6/1949 | Schwartz | 362/414 X |
| 2,619,368 | 11/1952 | Anderson | 403/164 |
| 2,630,538 | 3/1953 | Brede | 362/414 X |
| 2,793,286 | 5/1957 | Stiffel | 362/431 |
| 3,601,600 | 8/1971 | Cannon | 362/414 X |
| 3,694,647 | 9/1972 | Chapman, Jr. et al. | 248/168 X |
| 3,955,079 | 5/1976 | Chapman et al. | 362/413 |
| 4,034,214 | 7/1977 | Chapman et al. | 362/395 |
| 4,121,280 | 10/1978 | Chapman et al. | 362/418 |
| 4,247,886 | 1/1981 | Warshawsky | 362/427 |

FOREIGN PATENT DOCUMENTS

| | | | |
|---|---|---|---|
| 164166 | 10/1949 | Fed. Rep. of Germany | 362/414 |
| 414322 | 5/1946 | Italy | 362/414 |
| 470544 | 4/1952 | Italy | 362/413 |

*Primary Examiner*—Stephen C. Bentley
*Assistant Examiner*—John S. Maples
*Attorney, Agent, or Firm*—Hale and Dorr

[57] ABSTRACT

A floor lamp comprising a base, a stanchion tube including a foot portion that rests on the floor and is secured to the base, an upright portion that has a swivel, and a head portion that carries a socket and a shade. The head portion incorporates a dimmer within a dimmer housing, with the dimmer housing also having a swivel. The shade is preferably secured to this swivel.

4 Claims, 10 Drawing Figures

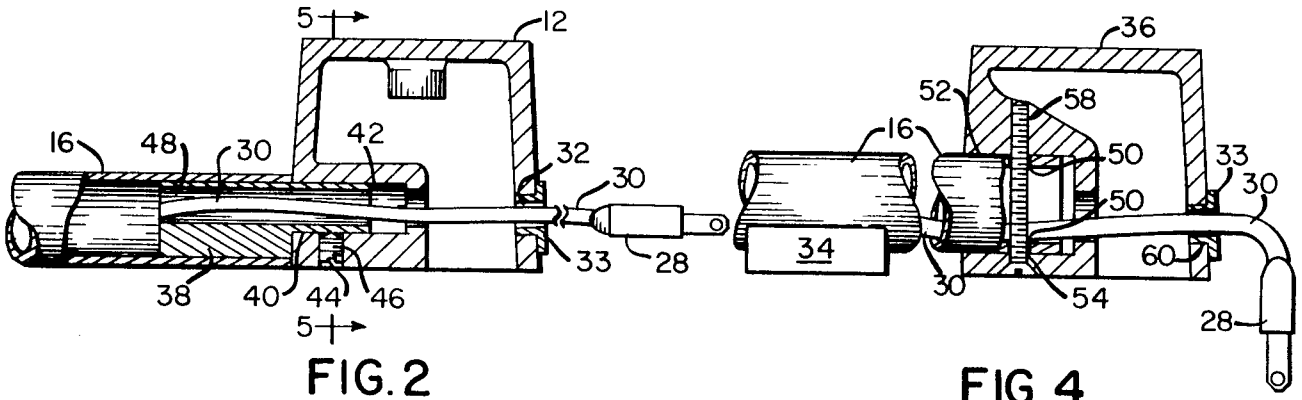
FIG. 2
FIG. 4
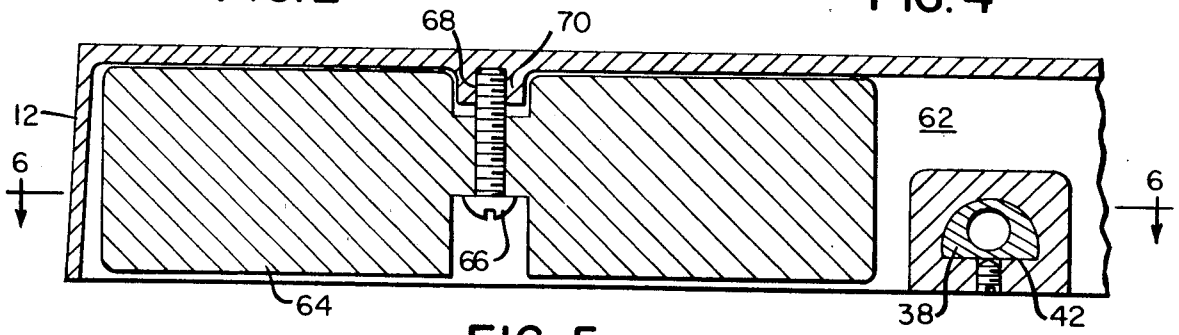
FIG. 5
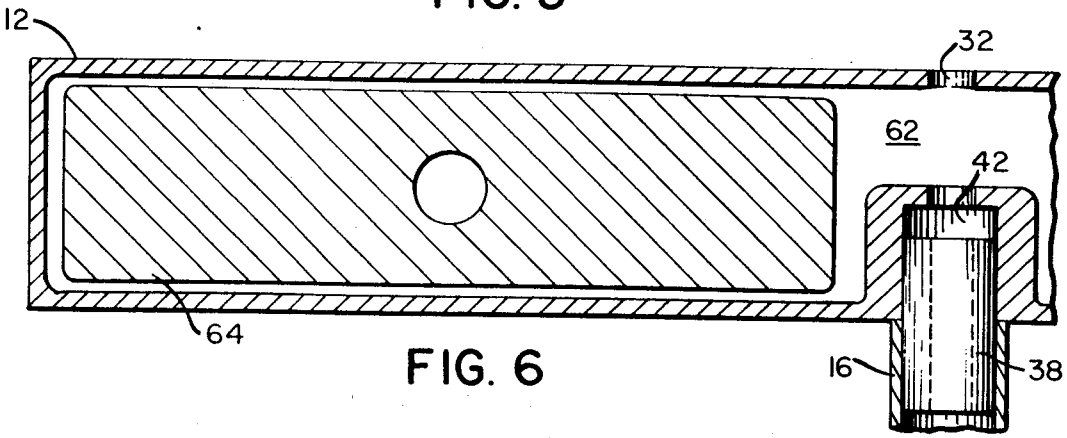
FIG. 6
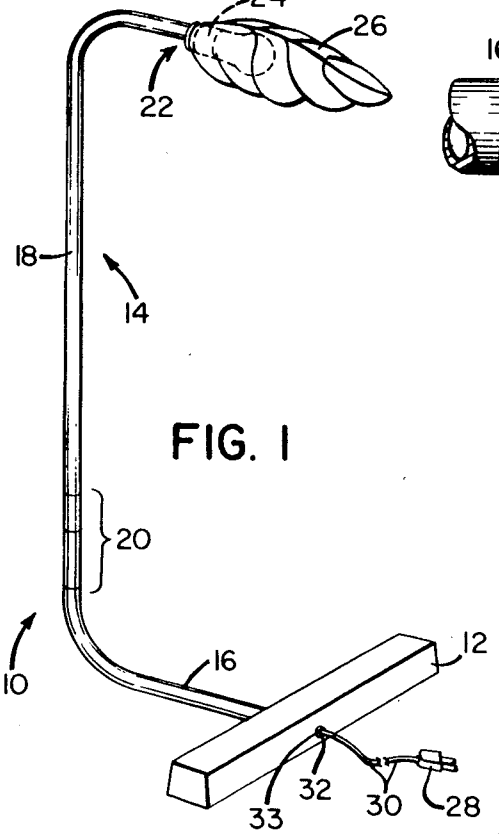
FIG. 1
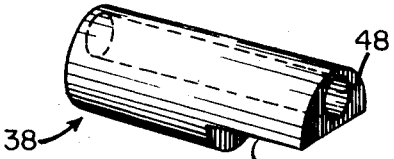
FIG. 3

FLOOR LAMP

This application is a continuation of application Ser. No. 261,675 filed May 7, 1981 now abandoned.

BACKGROUND OF THE INVENTION

1. Field of the Invention

The present invention relates generally to lamps and, more particularly, to a floor lamp characterized by a stanchion tube having a foot portion, an upright portion having a swivel and a head portion carrying a socket, a shade, and incorporating a second swivel.

2. The Prior Art

The prior art abounds with a multiplicity of floor lamps of differing designs and constructions. Each such design and/or construction of a floor lamp incorporates some advantages at the expense of some disadvantages. A floor lamp is basically designed for use as a reading lamp. People generally read while sitting at their desks or in chairs, on sofas, on beds, and sometimes on the floor. When reading, people need a lamp to illuminate whatever they are reading. Since most people tend to shift their weight and move somewhat even when continuing to sit in the same chair, they frequently wish to adjust their lamps so as best to illuminate the object of their visual attention. Others like to change their locale of reading from a desk to a chair or vice versa.

Most floor lamps in use today are constructed with a circular base, a vertical post concentrically secured to the base and carrying some kind of an adjustable head with a socket and a shade. Such floor lamps designed to be used adjacent chairs or sofas tend to be heavy and generally have a long vertical post. Other such floor lamps designed to be used on desk tops generally have a short vertical post. Thus, the two kinds are not interchangeable and cannot, in the absence of some other adjustments in furniture support, be moved from the desk top to adjacent a chair or vice versa. Furthermore, such floor lamps provide progressively greater adjustability but only at the expense of progressively greater complexity and hence expense. Consequently, the average reader is apt to have one lamp at his desk and another floor lamp by his favorite chair. Furthermore, traditional type adjustable floor lamps with circular bases increasingly have been replaced by desk lamps mountable to the edges of desk tops so as to leave the entire desk top free to accommodate paperwork even in areas previously occupied by the circular base of such a lamp. To some readers, even the most sophisticated features of adjustability cannot compensate for the loss of desk top space due to the circular base of the lamp.

There is thus a need for a floor lamp of simple design and unique construction that combines a high degree of adjustment with versatility of application both at a desk or adjacent a chair, sofa or the like.

SUMMARY OF THE INVENTION

It is a principal object of the present invention to overcome the above disadvantages by providing a floor lamp of simple design and unique construction that combines a high degree of adjustment in the orientation of the light source with great versatility in the application of the light source, be it at or near a desk or next to a chair, sofa or the like.

More specifically, it is an object of the present invention to provide a floor lamp characterized by a stanchion tube having a foot portion that rests on the floor and is secured to a base, an upright portion that has a swivel and a head portion that carries a socket and a shade. The head portion preferably incorporates a dimmer within a dimmer housing. Furthermore, the dimmer housing is provided with a swivel. The shade in turn is secured to the swivel. As a result, the shade is provided with a 360° swivel action about its longitudinal axis. Preferably, the floor lamp, or parts thereof, are formed of a plastic material, such as urethane or PVC, by injection molding, with other parts, such as the base formed of metal. In the alternative, all parts of the floor lamp are formed of metal, such as brass or the like. The base of the lamp is straight and the foot portion is secured either in line with or transversely to the base. The floor lamp can be positioned snugly adjacent a desk or a chair or located, behind pieces of furniture with equal ease. The swivel in the upright portion provides the floor lamp with an almost 360° horizontal adjustment and is constructed so as to form a flush mounted joint.

Other objects and advantages of the present invention will in part be obvious and will in part appear hereinafter.

The invention accordingly comprises the floor lamp, together with its components, parts and their interrelationships, which are exemplified in the present disclosure, the scope of which will be indicated in the appended claims.

BRIEF DESCRIPTION OF THE DRAWINGS

For a fuller understanding of the nature and objects of the present inventions, reference is to be made to the following detailed description, which is to be taken in connection with the accompanying drawings, wherein:

FIG. 1 is a perspective view of a floor lamp embodying the present invention;

FIG. 2 is a vertical section along the lines 2—2 in FIG. 1 and on an enlarged scale;

FIG. 3 is a perspective view of a component part, on an enlarged scale, of the floor lamp of FIG. 1;

FIG. 4 is a vertical section similar to that shown in FIG. 2 but disclosing an alternative embodiment thereof;

FIG. 5 is a section taken along the lines 5—5 in FIG. 2;

FIG. 6 is a horizontal section taken along the lines 6—6 in FIG. 5;

DETAILED DESCRIPTION OF THE PREFERRED EMBODIMENT

Figure 9:
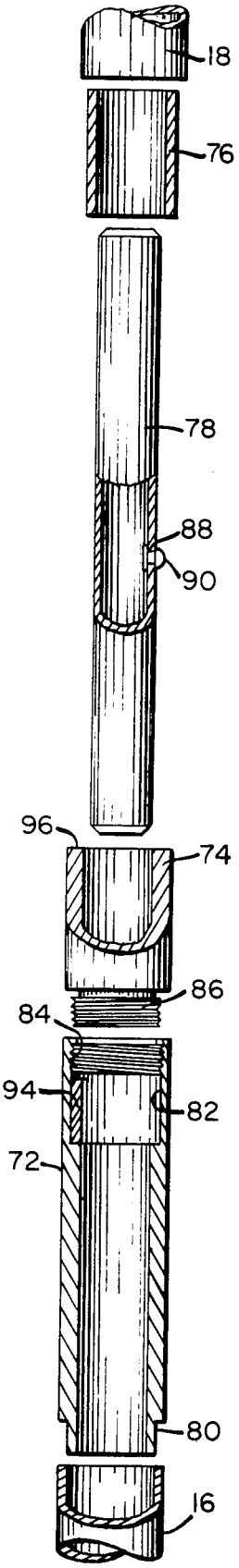
FIG. 9 is an exploded view, partly in section and on an enlarged scale, of the part of the floor lamp shown in FIG. 7.

Generally, the illustrated embodiment of a floor lamp 10 comprises a straight base 12, a "U"-shaped stanchion tube 14 having a foot or bottom portion 16, an upright or middle portion 18 and a head portion 22. A flush mounted swivel joint 20, that is basically a swivel-stop mechanism, while forming a part of the upright portion 18, essentially serves as a connecting link between the foot portion 16 and the upright portion 18. The head portion 22 carries a socket 24 and a shade 26. A male plug 28, connected to a power cord 30, is designed to be plugged into a conventional electrical receptacle (not shown). The power cord 30 is admitted through a hole 32, provided with a plug 33, into the base 12 and hence through the stanchion tube 14 to the socket 24.

In one preferred embodiment illustrated in FIGS. 1 and 2, the foot portion 16 of the "U"-shaped stanchion tube 14 is designed to rest on the floor and is flush with the bottom of the base 12. In a second preferred embodiment illustrated in FIG. 4, the foot portion 16 of the "U"-shaped stanchion tube 14 is provided at its underside with a pad portion 34 soldered or otherwise secured thereto. It is this pad portion 34 that now rests on the floor and that is flush with the bottom of a slightly different base 36. It is the manner of connecting the foot portion 16 to the base 12 or to the base 36 that distinguishes the two embodiments, however. Other types of bases and further types of connections between those bases and the foot portion 16 of the stanchion tube 14 will readily suggest themselves. For instance, the base can be connected in line with, rather than transversely to, the foot portion 16. Such an in line base configuration gives the floor lamp 10 added placement opportunity, particularly behind pieces of furniture, such as a chest or the like. The floor lamp 10, when so placed behind furniture pieces, is particularly useful in providing light for wall-suspended items, and as photos or paintings. Further, such placement of the lamp 10 behind furniture pieces is useful in providing illuminunation on chest top located items, be they framed photos or decorations, without necessitating permanent overhead light installation. All thus provides added portability and enhanced versatility to the floor lamp 10.

In the first embodiment shown in detail in FIG. 2, a tubular adaptor 38 serves to fasten the foot portion 16 to the base 12. This tubular adaptor 38 is shown in perspective and on an enlarged scale in FIG. 3. One bottom end of the tubular adaptor 38 is machined flat so as to present a contoured end 40. The base 12, in turn, is formed with a complementary contoured aperture 42 designed snugly to receive the contoured end 40 of the tubular adaptor 38. The other end of the tubular adaptor 38 is machined so as to fit snugly within the free end of the foot portion 16 of the stanchion tube 14 and is secured therein, as by soldering. An externally threaded set screw 44, designed to be received within a tapped hole 46 formed in the bottom of the base 12, secures the contoured end 40, and thus the free end of the foot portion 16, to the base 12. An axial hole 48 is formed through the tubular adaptor 38 to accommodate the power cord 30 and allow the cord's 30 introduction into the interior of the stanchion tube 14 so as to effect electrical connection to the socket 24 secured to the head portion 22. As can be clearly observed in FIG. 2, in this first embodiment, the foot portion 16 is flush with the bottom of the base 12 and they both rest on the floor, with the straight base 12 being transverse to the foot portion 16. This type of mounting gives the floor lamp 10 a solid, steady stand. At the same time, this type of mounting allows for the floor lamp 10 to be moved quickly and easily to any new location in a room. As mentioned, the base 12 can also be mounted in line with the foot portion 16, particularly when it is desired to locate the lamp 10 behind pieces of furniture, such as a chest. Preferably, the size of both the foot portion 16 and of the base 12 is about twelve inches each. This size allows the positioning of the floor lamp 10 snugly adjacent a desk or chair so as, in effect, closely to hug the desk or chair. The floor lamp 10 can be positioned from either side of the desk or chair, and from the front of a desk or from the rear of a chair, so as to illuminate any area, as desired. The height of the floor lamp 10 is, of course, determined by the length of the upright middle portion 18 of the stanchion tube 14, including the swivel portion 20. Preferably, this height for the floor lamp 10 is slightly more than three feet, i.e., about thirty-seven inches. It should be noted that in an alternate embodiment, not shown, the upright middle portion 18 of the stanchion tube 14, incorporates a telescopic adjustment by means of which, the lamp's 10 height can be adjusted further to accommodate the convenience of the user. In the alternate embodiment, the power cord 30 is preferably spiraled within the stanchion tube 14 so as to accommodate a heightwise adjustment of the upright portion 18.

The second preferred embodiment of securing the foot portion 16 to the base 36 is illustrated in FIG. 4. As mentioned, the foot portion 16 is provided with the pad portion 34 that rests on the floor and is flush with the bottom of the base 36. In this embodiment, there is no tubular adaptor 38, nor is the free end of the foot portion 16 otherwise shaped, except for the provision of a vertical through hole 50 that is preferably tapped. The base 36 is formed with a circular bore 52 having a diameter that is slightly greater than the outside diameter of the foot portion 16. An externally threaded screw 54 is designed to be received within a vertical tapped hole 58 formed in the base 36. Upon insertion of the free end of the foot portion 16 into the circular bore 52, care must be taken that the vertical holes 50 formed in the foot portion 16 are aligned with the vertical hole 58 formed in the base 12. The screw 54, when in place, firmly secures the foot portion 16 of the stanchion tube 14 to the base 36. The base 36 is, of course, also provided with a hole 60 to admit the power cord 30 therethrough and into the interior of the foot portion 16.

As mentioned, the base 12 and the base 36 are each preferably formed of a metal, such as brass, and each is provided with a pair of side compartments 62, one compartment 62 of about five inches on each side, as may be best observed in FIGS. 5 and 6. In order to give added stability to the floor lamp 10, these side compartments 62 are designed to accommodate a pair of cast iron weight loaders 64. Each of these weight loaders 64 is respectively secured within the compartments 62 by bolts 66 communicating with tapped holes 68 formed in bosses 70. Alternatively, the bases 12 and 36 are each formed of solid brass.

Figure 7:
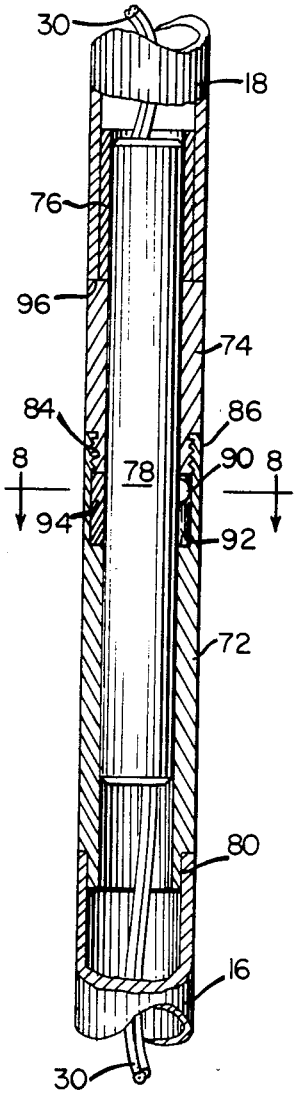
FIG. 7 is a vertical section, on an enlarged scale, of a part of the floor lamp of FIG. 1.
Figure 8:
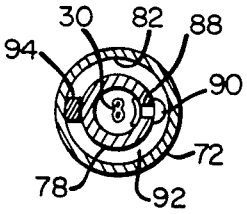
FIG. 8 is a horizontal section taken along the lines of 8—8 in FIG. 7.

As mentioned, the upright portion 18 of the stanchion tube 14 is preferably provided with the swivel-stop mechanism 20 now to be described. It should be noted, of course, that the swivel-stop mechanism 20 can be equally well incorporated into lamps of entirely different configuration from the floor lamp 10. For example, the swivel-stop mechanism 20 can form a part of a table-mounted lamp or a wall-mounted lamp, not shown. This swivel-stop mechanism 20 provides the floor lamp 10 with an almost 360° horizontal adjustability, about 180° in each direction from the position shown in FIG. 1. As best shown in FIGS. 7–9, the swivel-stop mechanism 20 essentially comprises a first tubular member 72, a collar member 74, a sleeve 76 and a second tubular member 78. The first tubular member 72 is formed with an externally reduced end 80 so as to fit snugly in the upper end of the foot portion 16. The other end of the first tubular member 72 is provided with an internally reduced well portion 82 whose edge 84 is internally threaded. The collar member 74 is formed with a complementary externally threaded portion 86 designed to mesh with the internally threaded edge 84 of the first tubular member 72. The sleeve 76 is designed to fit snugly within the lower end of the upright portion 18 and is secured therein, flush with the end of the upright portion 18, as by soldering. The upper end of the second tubular member 78 is designed to fit within the sleeve 76 and is secured therein, also as by soldering. The second tubular member 78 is provided with a hole 88 substantially midway, along its axial length to accommodate a protrusion 90 such as protruding rivet or pin. Protrusion 90 may, for example, be a brass rivet. The protruding rivet or pin 90 is designed to protrude into an annular space 92 created between the outer periphery of the second tubular member 78 and the smooth internally reduced wall portion 82 of the first tubular member 72. A radial stop member 94 (observe FIG. 8) is soldered into the annular space 92 and is designed to arrest the protruding rivet or pin 90, and thus the second tubular member 78, from rotating further. The radial stop member 94 preferably extends along the axial length of the smooth internally reduced wall portion 82 and is preferably about three mm thick.

In assembling the swivel-stop mechanism 20, the externally reduced end 80 of the first tubular member 72 is fitted into the upper end of the foot portion 16 and soldered in place. The radial stop member 94 is then soldered into the internally reduced wall portion 82. Next, the sleeve 76 is fitted flush into the lower end of the upright portion 18 and soldered in place, followed by inserting the upper end of the second tubular member 78 within the sleeve 76 and having it soldered in place. The collar member 74, with its externally threaded portion 86 facing toward the first tubular member 72, is slid up over the free end of the second tubular member 78 past the hole 88. With hole 88 exposed, the protruding rivet or pin 90 is inserted into the hole 88 and the second tubular member 78 slipped into the first tubular member 72. The collar member 74 is finally threaded onto the first tubular member 72, rotatably securing thereby the upright portion 18 to the foot portion 16. The upper end of the collar, member 74 serves as a flat swiveling end surface 96 on which the mating, flat, lower end surface of the upright portion 18 and the therewith flush sleeve 76 ride. The protruding rivet or pin 90 prevents disassembly without first unscrewing the collar member 74 from the first tubular member 72.

In an alternative embodiment of the swivel-stop mechanism 20, this alternative mechanism comprises two injection molded parts formed from a plastic material, such as urethane or PVC. The two injection molded parts are designed respectively to be secured by suitable adhesive within the upper end of the foot portion 16 and the bottom end of the upright portion 18 of the stanchion tube 14. One of the two injection molded parts includes an integrally formed swivel stop means designed to cooperate with a protruding member integrally formed with the second of the two injection molded parts. The swivel stop means and the protruding member cooperate to provide the lamp 10 with an almost 360° swivel action. It is to be noted that in this alternative swivel-stop mechanism, the swivel surfaces are the abutting end surfaces of the foot portion 16 and of the upright portion 18 of the stanchion tube 14, since the two injection molded parts are secured respectively within the ends thereof.

Preferably, the first tubular member 72 is about three and a quarter inch long, the sleeve 76 is about one inch long, and the collar member 74 is about one inch and a quarter in length. Allowing for the introduction of adjacent parts into one another, the swivel-stop mechanism 20 adds about five inches overall to the length of the upright portion 18 of the stanchion tube 14.

Figure 10:
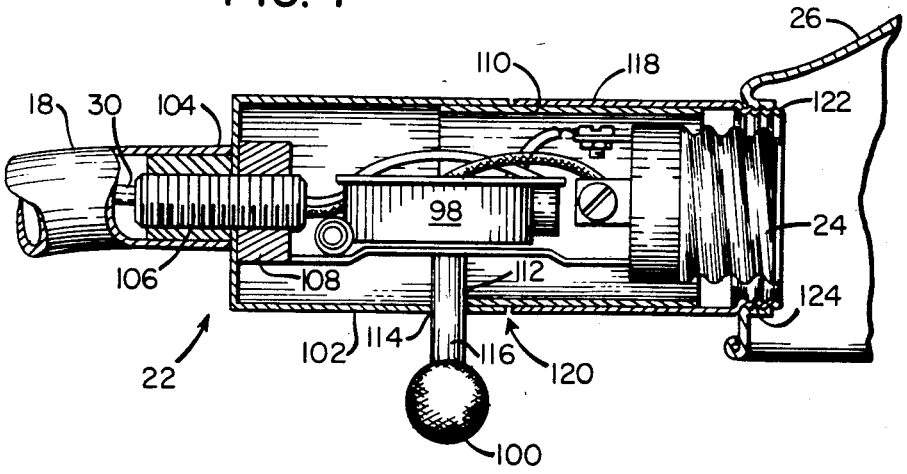
FIG. 10 is a fragmentary side elevation, partly in section, illustrating certain further details of the floor lamp.

FIG. 10 is a fragmentary side elevation, partly in section, illustrating a preferred way of securing the shade 26 to the head portion 22 of the stanchion tube 14. A dimmer 98, having a control knob 100, is shown mounted within a tubular dimmer housing 102. The dimmer housing 102 is fastened to the head portion 22 by the combination of an internally threaded bushing 104, an externally threaded hollow plug 106 and a securing member 108. The dimmer 98 is preferably secured between the securing member 108 and the socket 24. The power cord 30 is shown being admitted into the dimmer housing 102 through the hollow plug 106 and is appropriately connected to both the dimmer 98 and the socket 24. It will be appreciated that the dimmer 98 includes a variable impedance circuit operatively connected to the control knob 100. By turning the control knob 100, an operator can vary the variable impedance of the dimmer 98 and thus the intensity of light emitted by a light bulb secured in the socket 24.

Dimmer housing 102 further incorporates an inner sleeve 110 provided with an aperture 112 that registers with an aperture 114 formed in the dimmer housing 102. The apertures 112 and 114 permit the introduction therethrough of a stem 116 by which the control knob 100 is connected to the dimmer 98. The inner sleeve 110 extends from the dimmer housing 102 to about midway of the socket 24. An outer sleeve 118, whose internal and outer diameters are identical to those of the tubular dimmer housing 102, is slipped over the inner sleeve 110 until it abuts the end of the housing 102 as at 120. Outer sleeve 118 is frictionally engaged about the stationarily mounted inner sleeve 110 and is free to swivel thereabout. Outer sleeve's 118 free end is externally threaded as at 122 to be received in an internally threaded aperture 124 of the shade 26. It will be appreciated that the combination of the tubular dimmer housing 102, stationarily mounting the inner sleeve 110 which frictionally mounts the outer sleeve 118, defines a swivel with a 360° action for the shade 26 about its longitudinal axis.

Thus it has been shown and described a floor lamp 10 of characteristic construction that combines a high degree of adjustment in the orientation of the light source with great versatility in the positioning and application of that light source snugly against a chair or a desk so that the lamp 10 hugs the same, which floor lamp 10 satisfies the objects and advantages set forth above.

Since certain changes may be made in the present disclosure without departing from the scope of the invention, it is intended that all matter described in the foregoing specification or shown in the accompanying drawings, be interpreted in an illustrative and not in a limiting sense.

I claim:

1. A floor lamp comprising;

an elongated base; and a U-shaped stanchion tube having an extended foot portion adapted to rest on the floor and secured at its end to substantially the center of an elongated side of said base at an angle normal thereto, an upright portion with a swivel formed therein, and a head portion extending at substantially a right angle to the upright portion and substantially parallel to said foot portion, said head portion having a lamp socket mounted at the end thereof;

wherein said tube is formed of two members, a first member including said foot portion and a second member including said head portion, which members each include part of said upright portion and are connected at said swivel in a manner to form a flush mounted joint;

wherein said first member includes a tubular section having the same outer diameter as said first member but having a smaller inner diameter and having a flat end surface the end of said tubular section opposite to said flat surface being flush mounted and secured to the upright portion end of said first member;

a sleeve having an inner diameter which is the same as the inner diameter of said tubular section flush mounted inside the upright portion of said second member at its end to reduce the inner diameter of said member, said upright portion end with said sleeve therein having a flat end surface; and a tubular member dimensioned to fit and being snugly fitted in said tubular section and said sleeve and extending on both sides of said swivel;

said flat end surfaces of said tubular section and said second member abutting to form the swivel surfaces of said swivel.

2. A lamp as claimed in claim 1 including a protrusion formed as an integral part of said tubular member; and a stop means formed on an inside wall of said tubular section and adapted to interact with said protrusion to permit an almost 360° swivel action of said second member with respect to said first member.

3. A floor lamp comprising:

an elongated base;

a first stanchion tube having an extended foot portion adapted to rest on the floor and secured at its end to substantially the center of an elongated side of said base at an angle normal thereto, a right angle knee, and a vertical portion extending upward;

a second stanchion tube having an extended substantially horizontal head portion having a lamp socket mounted at the end thereof, a right angle knee, and a vertical portion extending downward, said first and second stanchion tubes having substantially the same outer diameters;

means for joining the ends of the vertical portions of said first and second stanchion tubes in a flush mounted joint which permits said second stanchion tube to be swiveled almost 360° with respect to said first stanchion tube;

wherein said first stanchion tube includes a tubular section having the same outer diameter as said first stanchion tube but having a smaller inner diameter and having a flat end surface, the end of said tubular section opposite to said flat surface being flush mounted and secured to the vertical portion end of said first stanchion tube;

a sleeve having an inner diameter which is the same as the inner diameter of said tubular section flush mounted inside the end of the vertical portion of said second stanchion tube to reduce the inner diameter of said second stanchion tube, said vertical portion and end with said sleeve therein having a flat end surface; and a tubular member dimensioned to fit and being snugly fitted in said tubular section and said sleeve and extending on both sides of said swivel;

said flat end surfaces of said tubular section and said second part abutting to form the swivel surfaces of said swivel.

4. A lamp as claimed in claim 3 including a protrusion formed as an integral part of said tubular member; and a stop means formed on an inside wall of said tubular section and adapted to interact with said protrusion to permit an almost 360° swivel action of said second stanchion tube with respect to said first stanchion tube.

* * * * *